United States Patent [19]

Ikeda

[11] Patent Number: 4,661,812

[45] Date of Patent: Apr. 28, 1987

[54] DATA TRANSFER SYSTEM FOR DISPLAY

[75] Inventor: Yoshiaki Ikeda, Hachioji, Japan

[73] Assignee: Fanuc Ltd, Minamitsuru, Japan

[21] Appl. No.: 536,878

[22] Filed: Sep. 29, 1983

[30] Foreign Application Priority Data

Sep. 29, 1982 [JP] Japan ..... 57-172460

[51] Int. Cl.[4] ..... G09G 1/16

[52] U.S. Cl. ..... 340/799; 340/798; 340/750

[58] Field of Search ..... 340/703, 748, 750, 798, 340/799, 802

[56] References Cited

U.S. PATENT DOCUMENTS

| | | | |
|---|---|---|---|
| 4,117,469 | 9/1978 | Lovim | 340/750 |
| 4,356,482 | 10/1982 | Oguchi | 340/799 |
| 4,368,461 | 1/1983 | Komatsu et al. | 340/703 |
| 4,379,293 | 4/1983 | Boisuret et al. | 340/798 |
| 4,388,621 | 6/1983 | Konatsu et al. | 340/802 |
| 4,418,343 | 11/1983 | Ryan et al. | 340/799 |
| 4,468,662 | 8/1984 | Tanaka | 340/799 |
| 4,482,979 | 11/1984 | May | 340/750 |
| 4,485,378 | 11/1984 | Matsui et al. | 340/798 |
| 4,511,965 | 4/1985 | Najaram | 340/750 |

*Primary Examiner*—Gerald L. Brigance

*Attorney, Agent, or Firm*—Staas & Halsey

[57] ABSTRACT

In a display, unit data for rewriting a picture memory is prepared in a work memory and the data is transferred to the picture memory utilizing the vertical blanking period of the picture being displayed on the screen. When the amount of data to be transferred is large, the data transfer is continued in excess of the vertical blanking period and during the data transfer the display on the screen is inhibited.

3 Claims, 6 Drawing Figures

DATA TRANSFER SYSTEM FOR DISPLAY

BACKGROUND OF THE INVENTION

The present invention relates to a display unit and, more particularly, to improvement in or relating to means for transferring data to a character memory or graphic memory.

In a display unit in which the content of a character memory or graphic memory, used as a picture memory, is cyclically read out therefrom by a scanning address from a CRT controller to provide a display, the content of the picture memory must be rewritten for changing the content of the display. For this rewrite it is customary in the prior art to generate a write cycle immediately after each read cycle of the picture memory by the CRT controller and to transfer data stored in a work RAM to the picture memory through a microprocessor or directly through utilization of a direct memory access (DMA) function. With such data transfer means, however, it is necessary to generate the write cycle by hardware, resulting in the defect of an increased number of parts forming the hardware. Further, the larger the screen becomes or the more resolution is raised, the shorter the write enable time becomes; therefore, when the amount of data to be transferred is large, the rewrite takes much time. Moreover, since the display is also provided during the rewrite operation, it is blurred, or it is not smoothly switched.

SUMMARY OF THE INVENTION

It is therefore an object of the present invention to provide a display unit which requires less hardware for the data transfer to the picture memory.

Another object of the present invention is to provide a display unit which permits the visually smooth switching of a display on the screen.

Briefly stated, the display unit of the present invention is adapted so that rewrite data for a picture memory is prepared in a work memory and is transferred therefrom to the picture memory through utilizing the vertical blanking period of the picture being displayed on the screen. To perform this, the display unit of the present invention is provided with data transfer means which, when started by a vertical synchronizing signal from a CRT controller, reads out the data of the work memory and transfers it to the picture memory during the vertical blanking period, and an address switching circuit for switching address outputs of the data transfer means and the CRT controller to the picture memory.

DESCRIPTION OF THE PREFERRED EMBODIMENTS

Figure 1A:
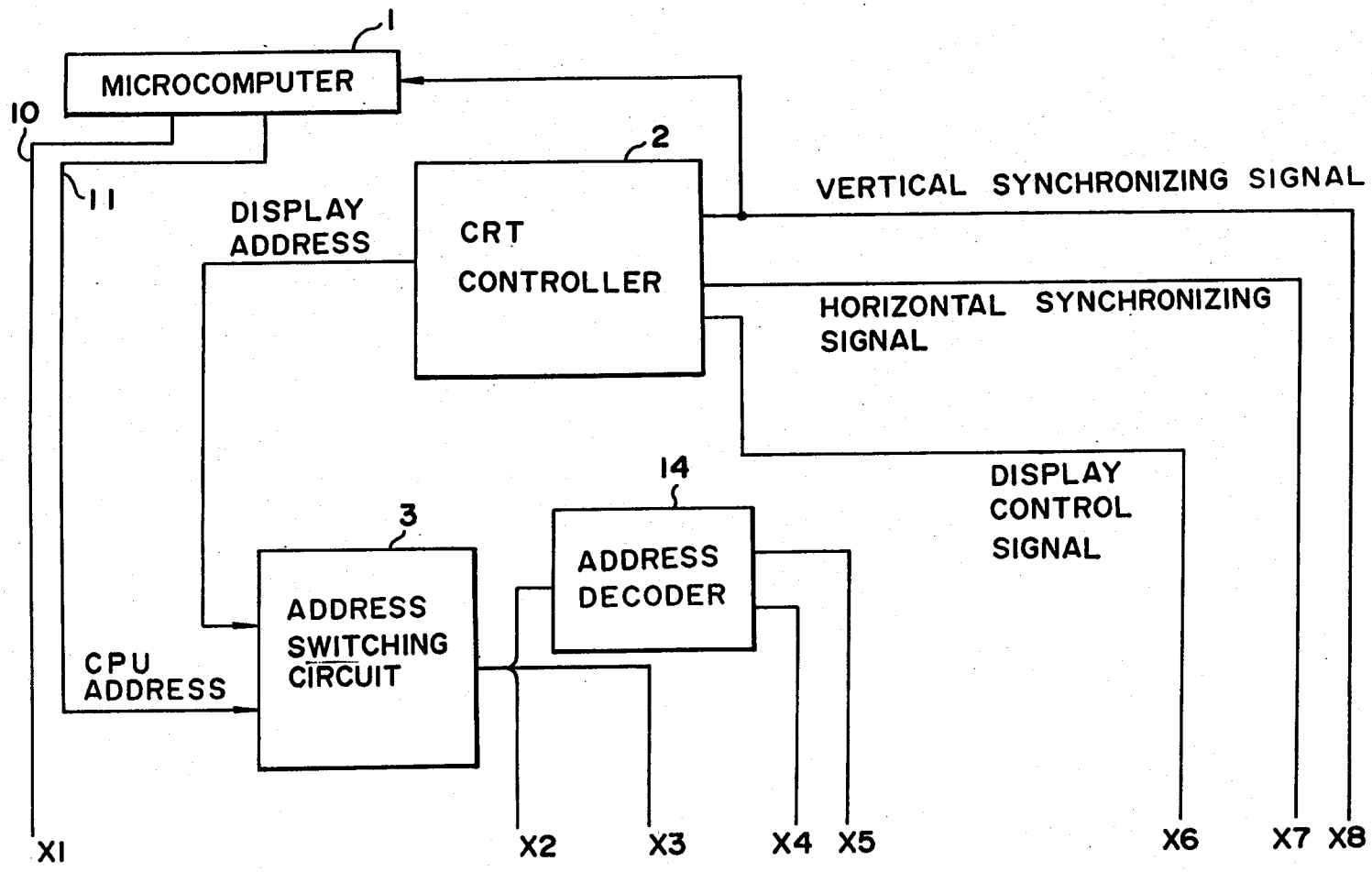
FIGS. 1A and B are block diagrams illustrating an example of the hardware arrangement of the display unit embodying the present invention.
Figure 1B:
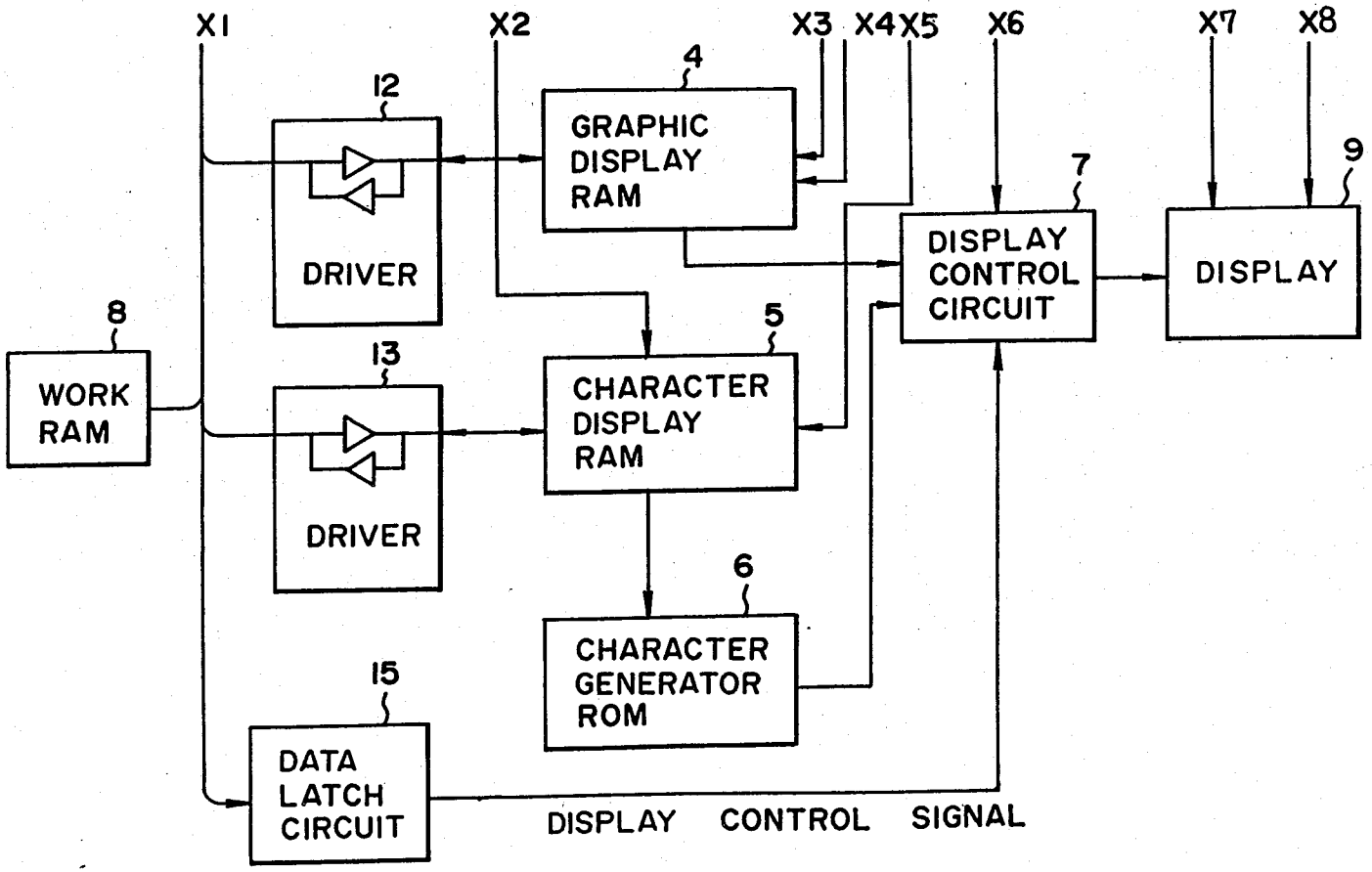

In FIGS. 1A and B, reference numeral 1 indicates a microcomputer; 2 designates a CRT controller; 3 identifies an address switching circuit; 4 denotes a graphic display RAM; 5 represents a character display RAM; 6 shows a character generator ROM; 7 refers to a display control circuit; 8 signifies a work RAM; 9 indicates a display; 10 and 11 designate a data bus and an address bus of the microcomputer 1; 12 and 13 identify drivers; 14 denotes an address decoder; and 15 represents a data latch circuit.

The microcomputer 1 follows a program stored in a ROM (not shown) to control operations of the display unit, such as preparation and write of new data for display and so forth. The microcomputer 1 is connected via the data bus 10 to the work RAM 8, the graphic display RAM 4, the character display RAM 5 and the data latch circuit 15 and via the address bus 11 to the address switching circuit 3. The address bus 11 is connected via the address switching circuit 3 to the graphic display RAM 4 and the character display RAM 5.

The CRT controller 2 generates an address for display (an address for scanning), a horizontal synchronizing signal, a vertical synchronizing signal and a display control signal. The address for display is applied via the address switching circuit 3 to the graphic display RAM 4 and the character display RAM 5, the horizontal synchronizing signal to the display 9, the vertical synchronizing signal to the display 9 and as an interrupt signal to the microcomputer 1, and the display control signal to the display control circuit 7.

The address switching circuit 3 receives switching control data (not shown) from the microcomputer 1 and switches an address from the microcomputer 1 (a CPU address) and the address for display which are applied to the graphic display RAM 4 and the character display RAM 5.

The graphic display RAM 4 is a writable/readable memory for storing a graphic form to be displayed on the screen of the display 9, and it has a storage area corresponding to the screen. The character display RAM 5 is a writable/readable memory for storing data on characters to be displayed on the screen, and its output is converted by the character generator ROM 6 into character data, which is provided via the display control circuit 7 to the display 9.

Figure 4:
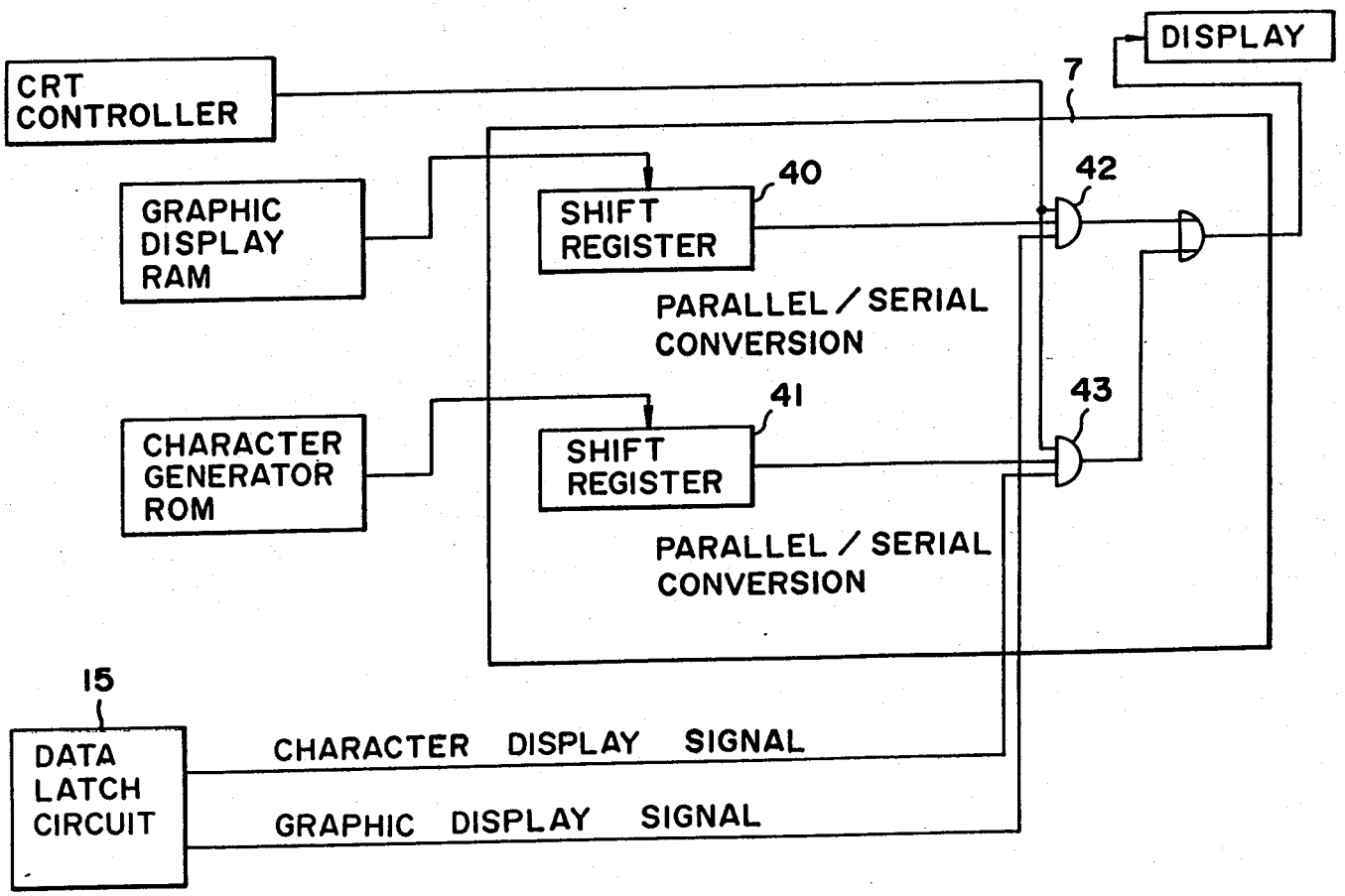
FIG. 4 is a circuit diagram illustrating an embodiment of a display control circuit for use in the present invention.

The display control circuit 7 subjects the output data of the graphic display RAM 4 and the character generator ROM 6 to parallel-serial conversion and gates them by a character display signal and a graphic display signal of the data latch circuit 15 and the display control signal of the CRT controller 2, producing a video signal. The display control circuit 7 comprises, as shown in FIG. 4, a shift register 40 for converting parallel data of the graphic display RAM 4 into serial data, a shift register 41 for converting parallel data of the character generator ROM 6 into serial data, an AND circuit 42 for ANDing the output of the shift register 40, the character display singnal of the data latch circuit 15 and the display control signal of the CRT controller 2, an AND circuit 43 for ANDing the output of the shift register 41, the graphic display signal of the data latch circuit 15 and the display control signal of the CRT controller 2, and an OR circuit 44 for ORing the outputs of the AND circuits 42 and 43.

The work RAM 8 is a memory which stores data for rewriting the graphic display RAM 4 and the character display RAM 5. The storage content of the work RAM 8 is formed by the microcomputer 1 during a display period, and is stored in the RAM 8.

Now, let it be assumed that data $\alpha$ and $\beta$ are stored in the graphic display RAM 4 and the character display RAM 5, respectively. In the display mode the address switching circuit 3 is connected to the side of the CRT controller 2, and the contents of the graphic display RAM 4 and the character display RAM 5 are read out therefrom in succession with addresses for display from the CRT controller 2, amd thus a graphic form and characters corresponding to the data $\alpha$ and $\beta$ are displayed on the screen of the display 9.

Figure 2A:
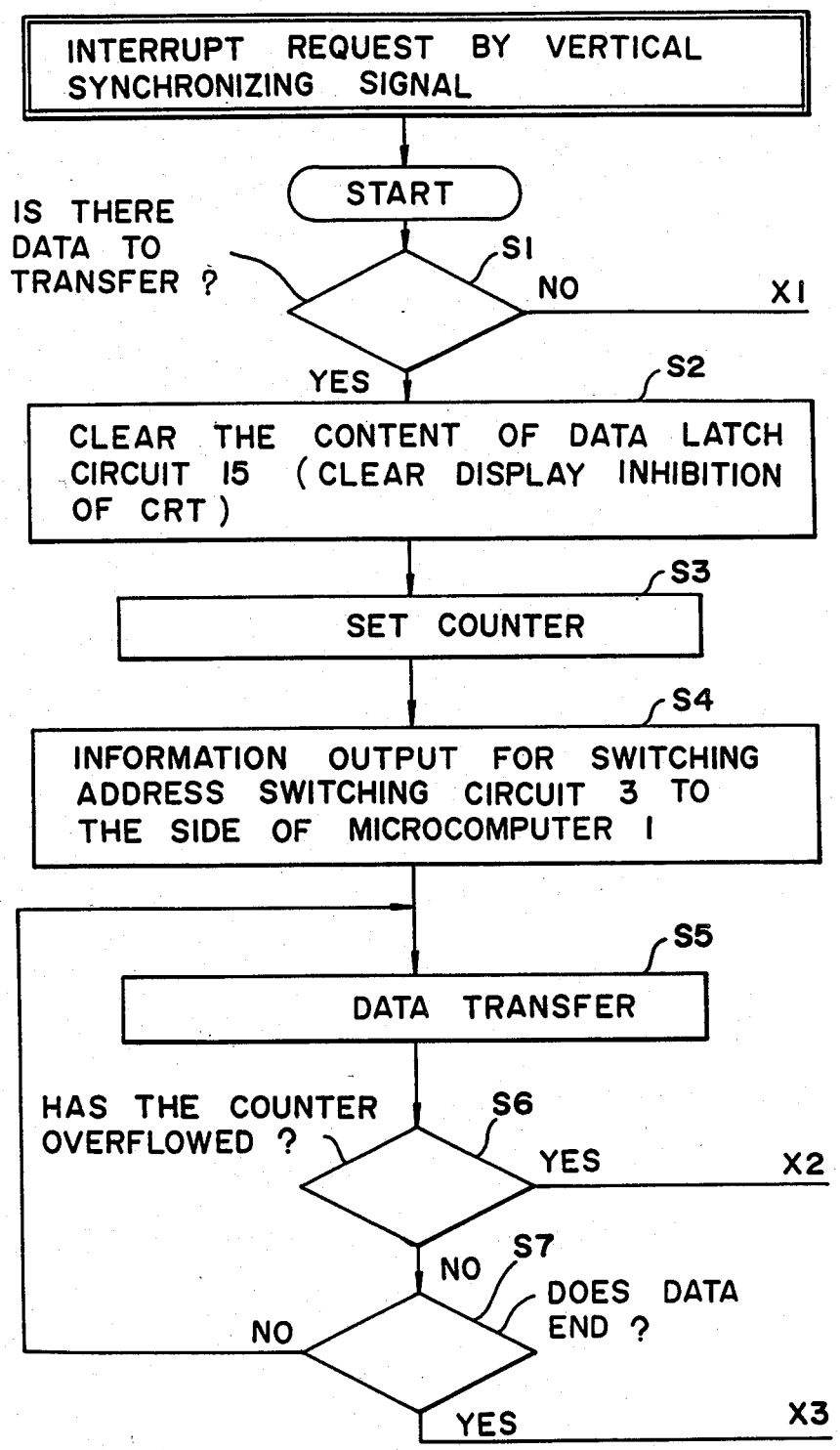
FIGS. 2A and B are flowcharts showing an example of the software arrangement of implementing data transfer means in the display unit of the present invention.

Upon generation of a vertical synchronizing signal from the CRT controller 2 at the end of one scanning of each of the graphic display RAM 4 and the character display RAM 5, the microcomputer 1 shifts to an interrupt mode, for executing processing as shown in FIGS. 2A and B.

In the interrupt mode the microcomputer 1 decides first whether or not there is data to be transferred (step S1) and, if not, completes the concerned processing. When the data to be transferred is present, the microcomputer 1, after clearing the content of the data latch circuit 15 (step S2), sets a counter (not shown) (step S3) and, for switching the address switching circuit 3 to the side of the microcomputer 1, outputs switching information to the address switching circuit 3 (step S4). In this case, since the abovesaid counter is designed so that the time until it overflows may be somewhat shorter than the non-display period (the vertical blanking period), the counter may also be implemented by software, or an exterior hardware counter may also be provided.

Next, the microcomputer 1 reads out from the work RAM 8 rewrite data (for example, graphic data $\alpha'$ and character data $\beta'$) prepared therein, and rewrites the contents of the corresponding addresses of the graphic display RAM 4 and the character display RAM 5 with the abovesaid data (step S5). During the transfer of this data it is detected whether the counter has overflowed or not, and whether the data ends or not (steps S6 and S7). In the case where the data ends before the counter overflows, this processing is finished. When the counter overflows before the data ends, the data transfer is stopped and it is checked whether the amount of data to be transferred is larger or smaller than a predetermined value (step S8).

Where the amount of data to be transferred is small, for example, when a part of a picture is modified, even a data transfer in the vertical blanking period alone does not take so much time and does not adversely affect the display, so that the processing is finished and the remaining data is transferred during the next interrupt. In the case where the amount of data to be transferred is large, for instance, when a picture is entirely modified, a data transfer only in the vertical blanking period takes much time and adversely affects the display, so that the following processing is carried out to interrupt the display period, executing the data transfer.

That is, in order to prevent that an unnecessary picture is displayed, by the interruption of the display period, the data latch circuit 15 is set first to make the character display signal and/or the graphic display signal a "0" to cause the display control circuit 7 to inhibit the display (step S9) and then the data transfer takes place until the data ends (steps S10 and S11). Upon completion of the data transfer, the switching information for switching the address switching circuit 3 to the side of the CRT controller 2 is output (step S12) and, at the time of input of the next vertical synchronizing signal, the data latch circuit 15 is reset to restart the display (step S13).

Figure 2B:
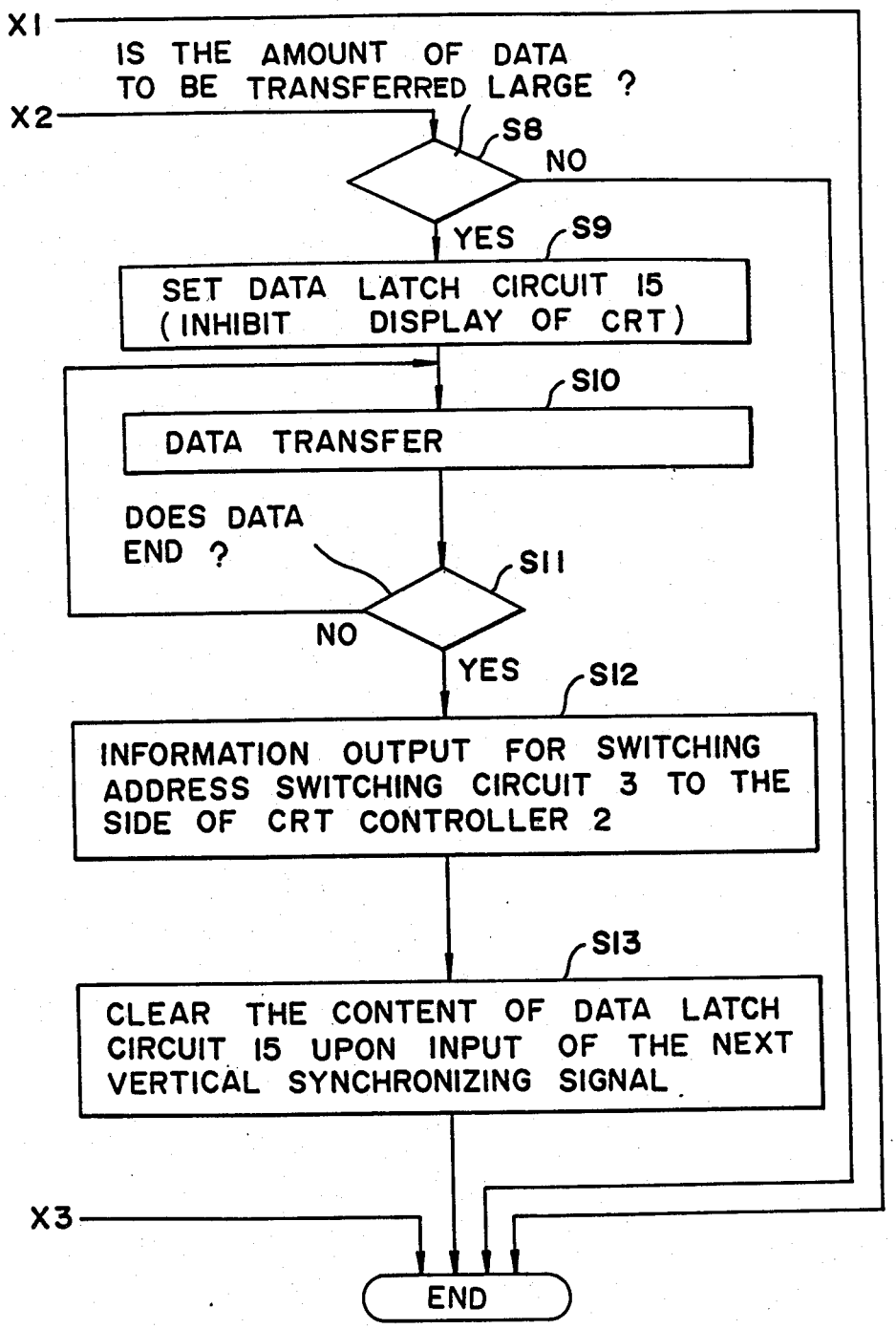
Figure 3:
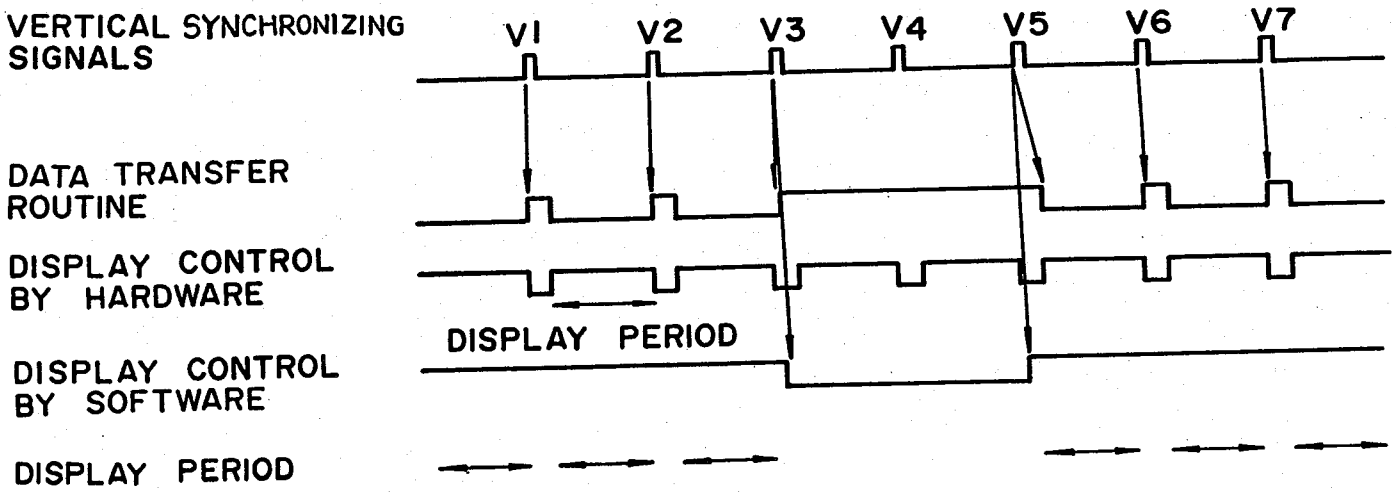
FIG. 3 is a timing chart showing signals occurring at respective parts of the system of FIGS. 2A and B when it is operated.

FIG. 3 is a timing chart illustrating the operative state of respective parts of the device shown in FIG. 2. Based on the display control signal from the CRT controller 2, the display in the vertical blanking period is inhibited by hardware processing in the display control circuit 7 and, in the case of servicing interrupts by vertical synchronizing signals V1; V2, V6 and V7, since when the amount of data to be transferred is small, the data is transferred only in the vertical blanking period. In the case of serving an interrupt by a vertical synchronizing signal V3, when the amount of data to be transferred is large, the display is inhibited by the display control signal from the data latch circuit 15 for two fields and in this period of time the data transfer takes place. At the time of input of the first vertical synchronizing signal after completion of the data transfer, the content of the data latch circuit 15 is cleared, thereby restarting the display.

As described above, according to this embodiment, since the data transfer only in the vertical blanking period and the data transfer using also the display period are switched depending on the amount of data to be transferred, the rewrite time does not increase as in the case of the data transfer utilizing only the vertical blanking period, and, further, it is possible to prevent flickering of the picture which is caused by frequently inhibiting the display as in the case of interrupting the display period whenever data to be transferred remain. Moreover, the data transfer utilizing the display period of several fields merely creates such a visual impression as if the picture disappeared for an instant, and it has substantially no bad influence on the recognition of the display, but rather produces the effect of facilitating the recognition of the portion that has been rewritten.

The present invention resides in the data transfer which utilizes the vertical blanking period and, accordingly, various modifications may be achieved within the scope of such a concept of the invention. For example, the data transfer may always be effected using only the vertical blanking period regardless of the amount of data, and when data remains, it may always be transferred by interrupting the display period. While the present invention has been described as being applied to the display unit which provides both graphic and character displays, the invention may also be applied to a display unit which displays only one of them, and it is also possible to adopt an arrangement that provides a color display.

As has been described in the foregoing, according to the present invention, rewrite data for a picture memory, prepared in a work memory, is transferred to the picture memory in the vertical blanking period of the picture, and a continuous data transfer can be achieved. Accordingly, the hardware arrangement, such as timing generating means and so forth, can be simplified as compared with the hardware arrangement used in the prior art in which each read cycle of the picture memory is immediately followed by the generation of a write cycle for data transfer. Moreover, in the case where the screen is made large and resolution is raised, the data transfer time is relatively reduced in the prior art and a large amount of data to be transferred exerts a bad influence on the display, but the present invention is free from such problems since a minimum transfer time is insured by the time corresponding to the vertical blanking period.

It will be apparent that many modifications and variations may be effected without departing from the scope of the novel concepts of the present invention.

What is claimed is:

1. A display unit comprising:

display means for providing a display during display periods between blanking periods;

a picture memory for storing data to be displayed in said display means during said display periods;

a CRT controller to provide scanning addresses to read out said picture memory to provide each said display and to provide a vertical synchronizing signal for each said blanking period;

a work memory for selectively storing data for rewriting the picture memory;

data transfer means started by each respective vertical synchronizing signal when said stored data for said rewriting exists in said work memory, for reading out the stored data from the work memory and for supplying adresses for transfering the data to the picture memory at least in the respective vertical blanking period corresponding to the respective vertical blanking signal, said data transfer means including means for deciding whether the amount of the existing stored data to be transferred is larger than a predetermined value, and for permitting said transfer of said stored data to continue beyond the respective vertical blanking period while inhibiting said display during said transfer of the stored data, until the transfer of all of the stored data corresponding to the respective vertical synchronizing signal is completed, when it is decided that the amount of the existing stored data to be transferred is larger than the predetermined value; and an address switching circuit controlled by said data transfer means for switching between supplying saod addresses from the data transfer means and from the CRT controller to the picture memory;

wherein said transfer of stored data by the data transfer means and said display of the data in the picture memory are provided depending on the amount of the existing stored data in said work memory, at the occurrence of the respective vertical blanking signal, that is to be transferred to said picture memory, and when said data in said word memory to be transferred to said picture memory is less than said predetermined value, but more than an amount to be transferred during a single one of said blanking periods, said stored data is transferred from said work memory to said picture memory in a successive plurality of blanking periods between respective ones of said displays.

2. A display unit comprising:

display means for providing a display during display periods between blanking periods;

a picture memory for storing data to be displayed in said display means during said display periods;

a CRT controller to provide scanning addresses to read out said picture memory to provide each said display and to provide a vertical synchronizing signal for each said blanking period;

a work memory for selectively storing data for rewriting the picture memory;

data transfer means started by each respective vertical synchronizing signal when said stored data for said rewriting exists in said work memory, for reading out the stored data from the work memory and for supplying addresses for transferring the data to the picture memory at least in the respective vertical blanking period corresponding to the respective vertical blanking signal;

an address switching circuit controlled by said data transfer means for switching between supplying said addresses from the data transfer means and from the CRT controller to the picture memory; and means for inhibiting said display while continuing the read out and transfer from said work memory, when the amount of data to be transferred is more than a predetermined value;

wherein said transfer of stored data by the data transfer means and said display of the data in the picture memory are provided depending on the amount of the existing stored data in said work memory, at the occurrence of the respective vertical blanking signal, that is to be transferred to said picture memory, so that when said data in said word memory to be transferred to said picture memory is less than said predetermined value, but more than an amount to be transferred during a single one of said blanking periods, said stored data is transferred from said work memory to said picture memory in a successive plurality of blanking periods between respective ones of said displays.

3. A display unit comprising:

a picture memory for storing data to be displayed;

a display means for displaying said data stored in said picture memory in display periods between blanking periods;

a CRT controller to output addresses for reading out said picture memory for each said display and a vertical synchronizing signal for determining each said blanking period;

a work memory for storing data for rewriting the picture memory;

data transfer means started by said vertical synchronizing signal, to read out the data from the work memory and to transfer the data to the picture memory at least in the respective vertical blanking period, and to provide addresses to said picture memory for writing the data stored in said work memory into respective addresses of the picture memory; and an address switching circuit controlled by said data transfer means for switching between address outputs of the data transfer and of the CRT controller to the picture memory;

wherein said data transfer means includes means for deciding whether the amount of said stored data to be transferred is larger than a predetermined value; and for permitting said data transfer to continue beyond the respective vertical blanking period while inhibiting said display during the data transfer, when it is decided that the amount of data to be transferred is larger than the perdetermined value, so that when said data in said word memory to be transferred to said picture memory is less than said predetermined value, but more than an amount to be transferred during a single one of said blanking periods, said stored data is transferred from said work memory to said picture memory in a successive plurality of blanking periods between respective ones of said displays.

* * * * *